US008661984B2

(12) United States Patent
Minnicino, II

(10) Patent No.: US 8,661,984 B2
(45) Date of Patent: Mar. 4, 2014

(54) SABOT

(75) Inventor: Michael A. Minnicino, II, Baltimore, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/530,319

(22) Filed: Jun. 22, 2012

(65) Prior Publication Data

US 2013/0000506 A1 Jan. 3, 2013

Related U.S. Application Data

(60) Provisional application No. 61/499,774, filed on Jun. 22, 2011.

(51) Int. Cl.
*F42B 14/06* (2006.01)

(52) U.S. Cl.
USPC ..... 102/521

(58) Field of Classification Search
None
See application file for complete search history.

(56) References Cited

U.S. PATENT DOCUMENTS

| | | | | |
|---|---|---|---|---|
| 4,187,783 | A * | 2/1980 | Campoli et al. | 102/520 |
| 4,802,415 | A * | 2/1989 | Clarke et al. | 102/434 |
| 4,833,995 | A * | 5/1989 | Gotz et al. | 102/521 |
| 5,359,938 | A * | 11/1994 | Campoli et al. | 102/521 |
| 7,935,208 | B2 * | 5/2011 | Park et al. | 156/212 |
| 2004/0244631 | A1 * | 12/2004 | Eches et al. | 102/521 |
| 2005/0188891 | A1 * | 9/2005 | Heitmann et al. | 102/523 |
| 2006/0032394 | A1 * | 2/2006 | Eches et al. | 102/521 |

* cited by examiner

*Primary Examiner* — Gabriel Klein
(74) *Attorney, Agent, or Firm* — Christos S. Kyriakou

(57) ABSTRACT

A sabot petal having an axis parallel to or coinciding with the launch axis. The sabot petal is formed from a plurality of stacked sheets of composite material consisting of a fiber reinforcement and a polymer resin matrix. Each composite sheet is in a plane rotationally offset from the meridional plane which is defined by the launch axis and radial axis of the sabot petal's cylindrical coordinate system.

5 Claims, 3 Drawing Sheets

SABOT

CROSS-REFERENCES TO RELATED APPLICATIONS

This application claims the benefit of U.S. Provisional patent application Ser. No. 61/499,774 titled "Sabots for Rifled Guns" filed on Jun. 22, 2011 listing Michael A. Minnicino II as a sole inventor, the entire contents, including all attachments and appendices of which are hereby incorporated herein by reference.

GOVERNMENT INTEREST

The invention described herein may be manufactured, used, and licensed by or for the United States Government.

BACKGROUND OF THE INVENTION

I. Field of the Invention

The present invention relates to launch packages that feature sabots to gun launch sub-caliber projectiles and penetrators.

II. Description of Related Art

Sabots have been long used, especially in military applications, to fire a projectile from a gun that is smaller than the bore diameter of the gun. Since the projectile is smaller than the diameter of the gun, it is necessary to trap the propellant gases inside the gun and behind the projectile while the projectile travels along the length of the gun. In order to achieve this, a sabot, comprised of a number of petals, is disposed around the projectile while an obturator around the petal ideally sealingly engages the internal bore of the gun. Once the projectile with the sabot exits from the gun, the sabot petals separate from the projectile so that only the projectile continues from the gun to the target.

In order to maximize the projectile velocity, previously known sabots have utilized composite materials adhered together and then machined or otherwise constructed to form the sabot petal. In one previously known sabot, a plurality of composite sheets of the same length and thickness are cut to differing widths and are stacked one upon the other such that the stacked sheets form a wedge. A number of wedges are then adhered together by a resin matrix to form a sabot petal so that the center sheet of composite material of each wedge lies in a radial plane. The shape of the sabot petal is then formed, for example, by turning the composite material on a lathe and then machining the sabot petal to the desired diameters. At least two, and typically three or more, petals then form the sabot.

Many of the previously known sabots were intended for use with a smooth bore gun barrel. Consequently, upon firing, the sabot is not subjected to large torsional loads.

Conversely, if the sabot is launched from a rifled barrel, the entire sabot is subjected to torsional loads due to the barrel rifling. For sabots constructed from sheets of composite material, the torsional load imposed during launch upon the sabot petal has been known to delaminate which can lead to not only inaccurate targeting of the projectile, but even safety issues if the delamination is severe.

SUMMARY OF THE PRESENT INVENTION

The present invention provides a sabot which overcomes the above mentioned disadvantages of the previously known sabots.

In brief, the launch package of the present invention includes the sabot and an elongated sub-projectile. Sabot petals are then mounted around the sub-projectile so that the axis of the sub-projectile and sabot petals is parallel to or coincides with the launch axis from the gun.

The sabot petal is constructed from a plurality of wedges each formed from stacked sheets of composite material comprised of the fiber reinforcement and polymer resin matrix. Each sheet of composite material lies in a plane that is rotationally offset from the meridional plane of the cylindrical coordinate system defined by the launch axis of the gun and the arbitrary and orthogonal radial axis, where the cylindrical axial axis is collinear with the axis of the gun. The rotational offset between the composite material plane and the meridional plane is the preset angle. This preset angle for the rear portion of the sabot rear of the slipband or obturator, preferably, is in a direction opposite from the direction of rotation of the sabot during launch through a rifled gun bore. The preset angle for the forward portion of the sabot may be in the same direction as the sabot rotation during launch through a rifled gun bore. Thus, in certain embodiments the present angle in the forward portion is in the opposite direction of the preset angle in the rear portion of the sabot. In practice, the small angular offset of the sheets of composite material from the radius of the sabot petal is sufficient to resist delamination of the sabot petal during launch from a rifled gun barrel. Typically, the angular offset is in the range of 1-15 degrees.

In a modification of the invention, in order to further protect the sabot petal from delamination during launch a metal bulkhead overwrap is disposed around the projectile at the bulkhead or location of the obturator. This metal bulkhead overwrap, furthermore, may be splined to the projectile so that the bulkhead overwrap rotates in unison with the projectile. By providing such a hybrid sabot, i.e. a sabot with both the metal overwrap and the composite petal, the torsional load on the composite petal of the sabot is greatly reduced during launch.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figures 1, 2, 3, 4:
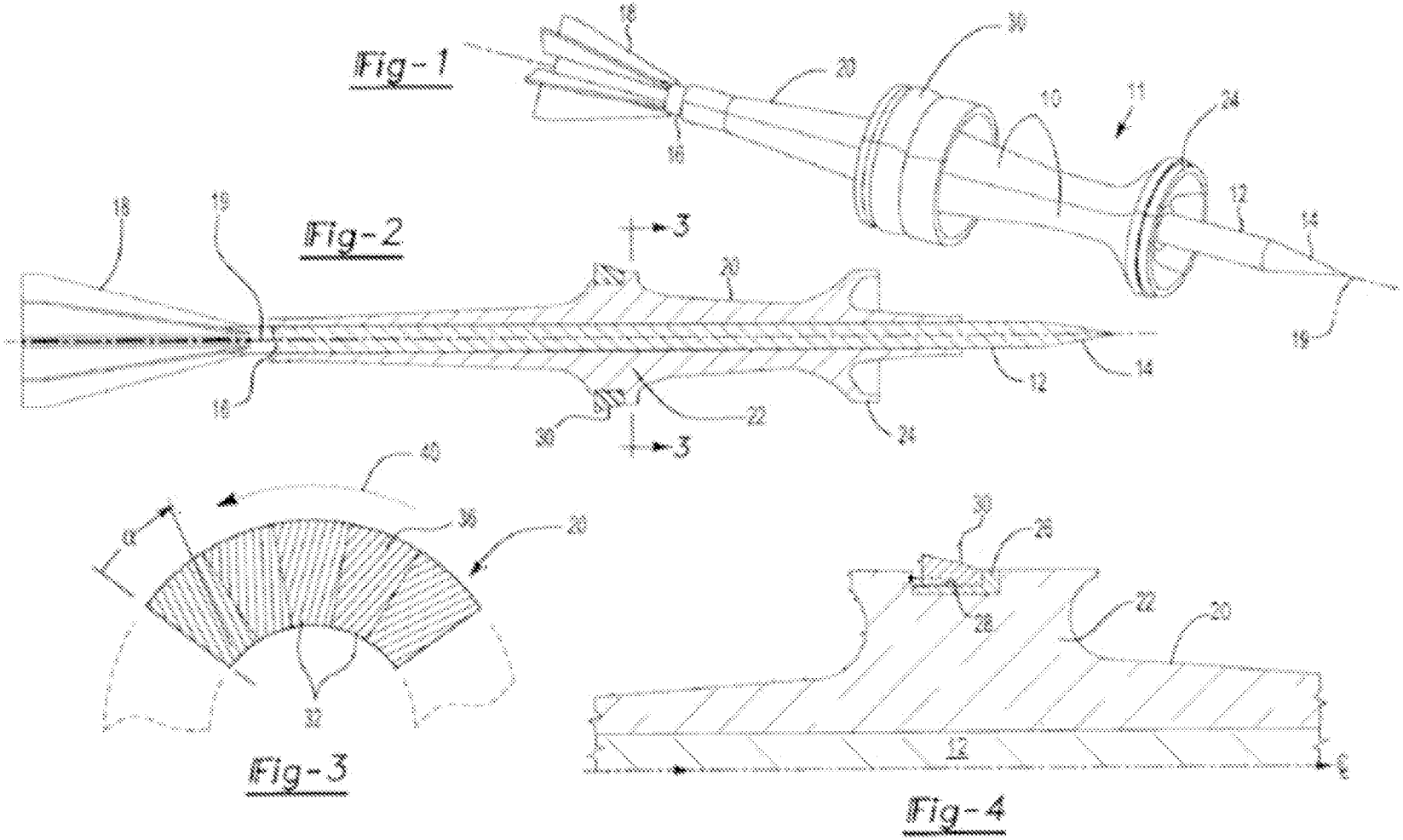
FIG. 1 is a side perspective view illustrating a preferred embodiment of the sabot of the present invention.
FIG. 2 is a sectional view thereof.
FIG. 3 is a fragmentary partial cross-sectional view of one petal taken on line 3-3 in FIG. 2 and enlarged for clarity.
FIG. 4 is a partial sectional view of the sabot petal-obturator band interface.

With reference first to FIGS. 1 and 2, a preferred embodiment of a sabot 10 according to the present invention is illustrated as a component of a launch package 11 consisting of a sabot 10, a sub-projectile 12 and a slipband 30. The launch package 11 includes an elongated projectile or penetrator 12 having an impact end 14 and a tail end 16. A fin set 18 is attached to the tail end 16 of the sub-projectile 12. The sub-projectile 12 can be constructed of any suitable material, such as a dense metal or dense metal alloy.

The launch package 11 is adapted to be launched from a gun barrel along a predetermined launch axis. This launch axis is parallel to or coincides with an axis 19 of the sub-projectile 12.

The diameter of the sub-projectile 12 is less than the inside diameter of the gun bore used to launch the launch package 11. Consequently, the launch package 11 includes a sabot 10 which is comprised of a number of petals 20 that encase at least a portion of the sub-projectile 12.

With reference still to FIGS. 1 and 2, the sabot petal 20 includes a bulkhead 22 having an outside diameter substantially the same or slightly less than the internal bore of the gun used to launch the launch package 11. The sabot petal 20 also includes a bourrelet 24 which also has an outside diameter substantially the same or slightly less than the gun bore used to launch the launch package 11.

The bulkhead 22 carries the slipband obturator 30 for the sabot 10. As best shown in FIG. 4, in order to obtain a good fluid seal between the bulkhead 22 and the internal bore of the gun, a bandseat 26 having an outer annular surface 28 is disposed within a recess extending annularly around the bulkhead 22. A slipband obturator 30 capable of rotation relative to the bandseat 26 is then disposed within the bandseat 26. A portion of the outer periphery of the slipband 30 engages the inner bore of the rifle to seal the slipband 30, and thus the sabot petal 20, to the gun bore. Slipband 30, furthermore, may take various cross sectional shapes, such as the trapezoidal shape illustrated in FIG. 4.

With reference now to FIGS. 2 and 3, each sabot petal is preferably formed from a plurality of circumferentially spaced wedges 32, each wedge formed by a plurality of stacked composite sheets or laminae that are adhered together to form the petal 20 by a cured polymer matrix or another adhesive composition. After the wedges 32 are adhered together, the sabot petal may undergo further machining, such as by lathe machining, to form the outer periphery of the sabot petal 20. The actual diameter of the wedges 32 after final machining will, of course, vary from the forward ramp 24 and to a tail end 34 of the petal 20.

Each wedge 32 is substantially identical to the other wedges 32. Consequently, only a single wedge 32 will be described in detail, it being understood that a similar description will also apply to the remaining wedges 32.

With reference then to FIG. 3, the wedge 32 is constructed from a plurality of sheets 36 of a composite material. The sheets 36 of composite material are adhered together by the cured polymer resin matrix component of the composite material.

The sheets 36, furthermore, are oriented so that their plane normal is not orthogonal to the radial axis of the sabot 10. Specifically, the sheets 36 are oriented so that their plane normal is not orthogonal to the meridional plane defined by the sabot's radial and axial axes nor parallel to the meridional plane defined by the sabot's radial and axial axes. Thus, the sheets are not radially oriented nor perpendicularly oriented to the axis of the sabot and are offset from the radial axis of the sabot by a specific angle. Additionally, the plane of each sheet 36 is purposely angularly offset from a radial axis of the sabot 10 axis by a preset angular amount $\alpha$. In other words, the sheets 36 are oriented in a plane that is rotated relative to the meridional plane defined by the radial and axial axes of the sabot petal. The angle between the composite plane containing the individual sheets 36 and the meridional plane is the preset angle $\alpha$. This preset angular amount $\alpha$ is preferably in the range of from about 1 to about 20 degrees, preferably in the range of from about 1 to about 15 degrees, more preferably in the range of from about 2 to about 10 degrees and still more preferably in the range of from about 5 to about 10 degrees. For example, the sheets 36 of composite material illustrated in FIG. 3 are angularly offset from the radius of the sabot 10 in the clockwise direction if the direction of rotation of the launch package 11, hence also the sabot 10, imparted by the barrel rifling is in the counterclockwise direction as shown by arrow 40. In certain embodiments, the preset angle the same in the front half and the back half of the sabot and is in the direction opposite from the direction of rotation imparted by the gun barrel rifling. Thus in at least one embodiment, the preset angle in the back half of the sabot is preferably in the direction opposite from the direction of rotation imparted by the gun barrel rifling and the preset angle in the front half of the sabot is in the direction of rotation imparted by the gun barrel rifling. In such an embodiment, the preset angle for the front half can vary from the preset angle for the rear half.

In operation, the angular offset a of the sheets 36 of composite material relative to the sabot 10 radial axis has been found to effectively prevent delamination of the sheets 36 of composite material during the gun launch of the sabot. Immediately following launch, the individual sabot petals 20 separate from the sub-projectile 12 in the conventional fashion.

It has been observed that even though the slipband 30 (FIGS. 1 and 2) may rotate at a faster speed than the sabot 10, the friction between the slipband 30 and the bandseat 26 is sufficient to rotatably drive the launch package 11 and thus create a torsional load on the sabot 10 and therefore, each of the sabot petals 20.

Figure 5:
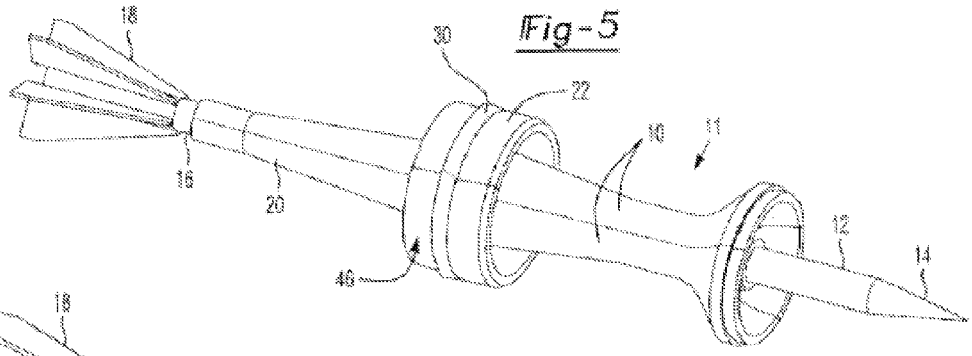
FIG. 5 is an elevational view illustrating a modification of the sabot petal.
Figure 6:
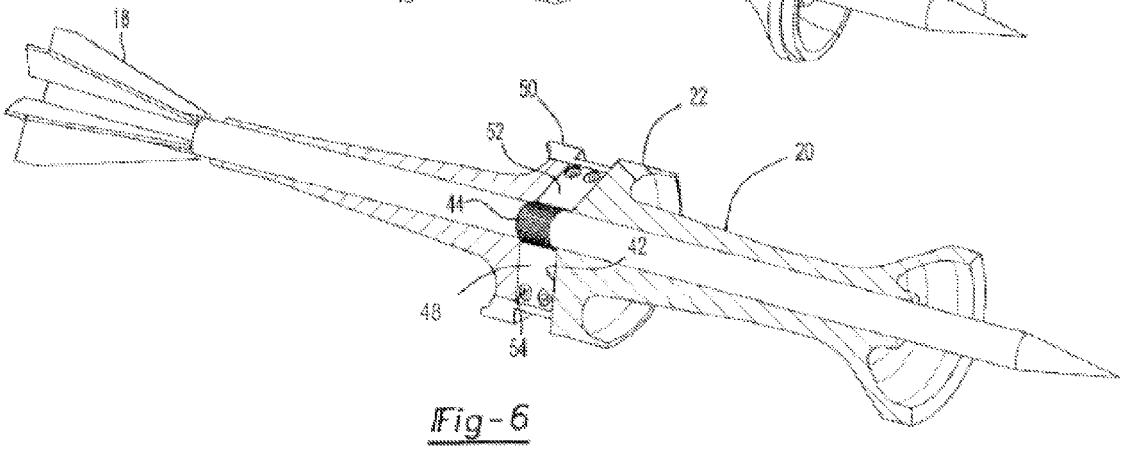
FIG. 6 is a view of the modification of the present invention and with parts removed for clarity.

In order to further reduce the torsional load on the sabot petal, as best shown in FIGS. 5 and 6, the sabot petal 20 optionally includes an annular channel 42 which extends around the periphery of the bulkhead 22 thus exposing a short axial section of the sub-projectile 12. This axial section of the sub-projectile 12, furthermore, includes a plurality of splines 44.

Figure 7:
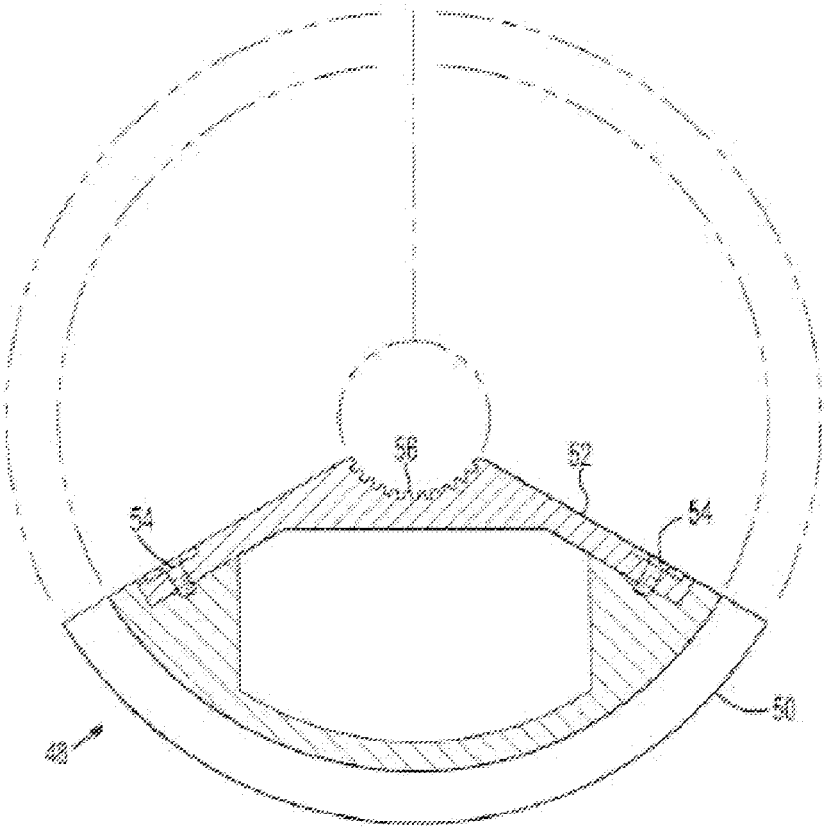
FIG. 7 is an end view of one section of the bulkhead overwrap.
Figure 8:
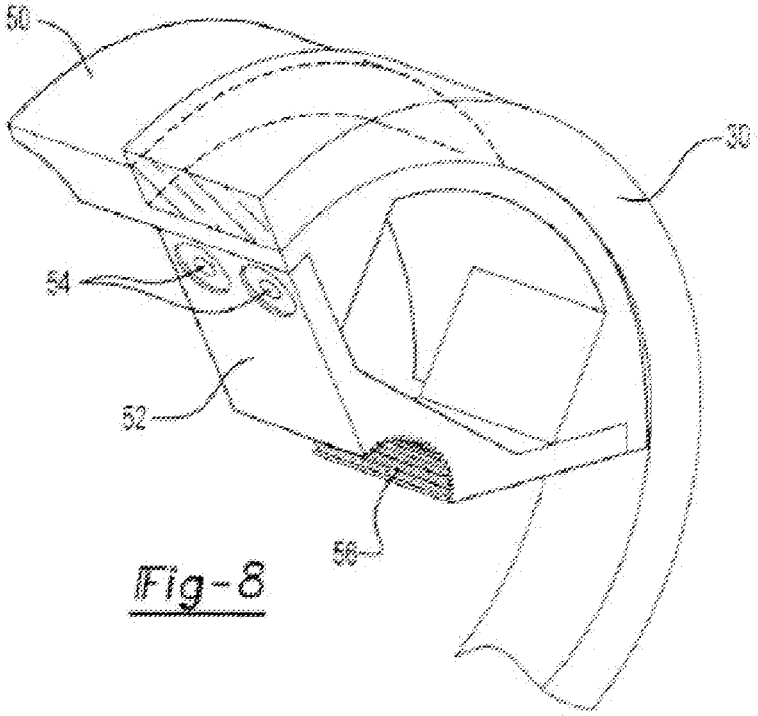
FIG. 8 is an elevational view of one section of the bulkhead overwrap.

A metal bulkhead overwrap section 48 is disposed within the bulkhead channel 42. Preferably, the bulkhead overwrap assembly 46 is constructed in multiple, for example three separate bulkhead sections 48 (FIGS. 7 and 8), each of which extends for 120 degrees. Multiple bulkhead sections 48 are needed to enable the bulkhead overwrap 46 to discard upon firing.

Each bulkhead overwrap section 48 preferably comprises a bulkhead arch 50 made of metal which extends around the outer periphery of the bulkhead 22. A V-spar 52, also made of metal, is then secured to the bulkhead arch 50 by any conventional means, such as screws 54. The combination of the metal V-spar 52 and metal bulkhead arch 50 provides a rigid and yet relatively lightweight construction.

All bulkhead overwrap sections 48 are preferably secured to the sub-projectile 12 against rotation. In order to accomplish this, the V-spar 52 of each section 48 preferably includes a plurality of longitudinally extending splines 56 which mesh with like shaped splines formed in the sub-projectile 12. A slipband 58 (FIG. 5) and 30 (FIG. 1) is then disposed over the assembly of bulkhead overwrap sections 48 to hold the bulkhead overwrap sections 48 together in addition to holding the sabot petals together. Alternatively, the splines 44 on the sub-projectile are annular and functionally driven by the splines 56 on the bulkhead overlap.

In practice, any torsional load imposed by the slipband on the assembly of bulkhead overwrap sections 48 is transmitted directly to the sub-projectile 12, rather than the sabot petal 20. As such, the possibility of delamination of the sabot petal 20 caused by the torsional load of a rifled gun barrel during launch is decreased.

From the foregoing, it can be seen that the present invention provides a simple yet effective sabot which is particularly useful in military applications. Having described my invention, however, many modifications thereto will become apparent to those skilled in the art to which it pertains without deviation from the spirit of the invention as defined by the scope of the appended claims.

I claim:

1. An launch package adapted to be gun launched along a launch axis comprising:

a sabot having an assembly of a discrete number of elongated sabot petals that form the sabot with a sabot axis parallel to or coinciding with the launch axis, an elongated sub-projectile extending longitudinally through said assembly of sabot petals, wherein said assembly of sabot petals includes a bulkhead and comprises a slipband disposed around said bulkhead, said slipband being rotatable about said sabot axis relative to said bulkhead, wherein said bulkhead includes a bulkhead overwrap separate from said assembly of sabot petals, said bulkhead overwrap being secured against rotation relative to said assembly of sabot petals and extending completely annularly around the said assembly of sabot petals, wherein said bulkhead overwrap comprises at least two separate circumferentially spaced sections positioned within an annular channel in said bulkhead and extends radially through said sabot to contact and restrain said sub-projectile against movement relative to the bulkhead overwrap, and wherein said bulkhead overwrap is configured to travel with the sabot during launch.

2. The launch package as defined in claim 1 wherein said bulkhead overwrap is constructed of metal.

3. The launch package as defined in claim 2 wherein said at least two circumferentially spaced sections of said bulkhead overwrap comprise at least three sections.

4. The launch package as defined in claim 3 wherein each section comprises a bulkhead arch and a V-spar secured to said bulkhead arch.

5. The launch package as defined in claim 4 wherein said V-spar includes splines which intermesh with splines on the sub-projectile to lock said bulkhead overwrap to said sub-projectile against rotation.

* * * * *